US008599231B2

(12) United States Patent
Jugle et al.

(10) Patent No.: US 8,599,231 B2
(45) Date of Patent: Dec. 3, 2013

(54) METHOD AND APPARATUS FOR INDICATING A PART NUMBER FOR A CONSUMABLE TO BE USED IN AN IMAGE PRODUCTION DEVICE

(75) Inventors: Kip L. Jugle, Bloomfield, NY (US); Andrew Scott Bradford, Rochester, NY (US); Heiko Rommelmann, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 265 days.

(21) Appl. No.: 13/162,014

(22) Filed: Jun. 16, 2011

(65) Prior Publication Data

US 2012/0321326 A1 Dec. 20, 2012

(51) Int. Cl.
*B41J 2/315* (2006.01)

(52) U.S. Cl.
USPC ..... 347/212

(58) Field of Classification Search
USPC ..... 347/171, 101, 212
See application file for complete search history.

(56) References Cited

U.S. PATENT DOCUMENTS

| | | | | |
|---|---|---|---|---|
| 6,532,351 | B2 | 3/2003 | Richards et al. | |
| 7,106,198 | B2 | 9/2006 | Phipps et al. | |
| 7,196,627 | B2 | 3/2007 | Rommelmann et al. | |
| 7,504,951 | B2 | 3/2009 | Phipps et al. | |
| 7,522,067 | B2 * | 4/2009 | Jensen et al. | 347/101 |
| 2002/0060728 | A1 * | 5/2002 | Koizumi et al. | 347/101 |
| 2007/0103528 | A1 * | 5/2007 | Pearl et al. | 347/101 |

* cited by examiner

*Primary Examiner* — Kristal Feggins
(74) *Attorney, Agent, or Firm* — Ronald E. Prass, Jr.; Prass LLP

(57) ABSTRACT

A method and apparatus for indicating a part number for a consumable to be used in an image production device is disclosed. The method may include generating a pre-printed label that includes one or more potential part numbers for the consumable with an indication area proximate to the one or more potential part numbers, the indication area including reactive material, attaching the preprinted label on packaging for the consumable, determining a desired part number from the one or more potential part numbers for the consumable, and indicating the desired part number for the consumable by activating the reactive material proximate to the desired part number.

25 Claims, 5 Drawing Sheets

METHOD AND APPARATUS FOR INDICATING A PART NUMBER FOR A CONSUMABLE TO BE USED IN AN IMAGE PRODUCTION DEVICE

BACKGROUND

Disclosed herein is a method for preventing premature or unnecessary replacement of a consumable used in an image production device, as well as corresponding apparatus and computer-readable medium.

Through the box programming of tag memory devices that may be associated with a consumable to be used in an image production device, such as, but not limited to, a toner cartridge, may allow the tag memory device to be reprogrammed at a distribution center just before shipment to a customer.

When changing the tag memory device programming, it may be required to physically mark the packaging of the consumable to indicate that because of the tag memory device programming change, the part number of the consumable is now different. Currently, an easy method of physically marking the exterior of the packaging with the proper part number does not exist.

SUMMARY

A method and apparatus for indicating a part number for a consumable to be used in an image production device is disclosed. The method may include generating a pre-printed label that includes one or more potential part numbers for the consumable with an indication area proximate to the one or more potential part numbers, the indication area including reactive material, attaching the preprinted label on packaging for the consumable, determining a desired part number from the one or more potential part numbers for the consumable, and indicating the desired part number for the consumable by activating the reactive material proximate to the desired part number.

DETAILED DESCRIPTION

Figure 1:
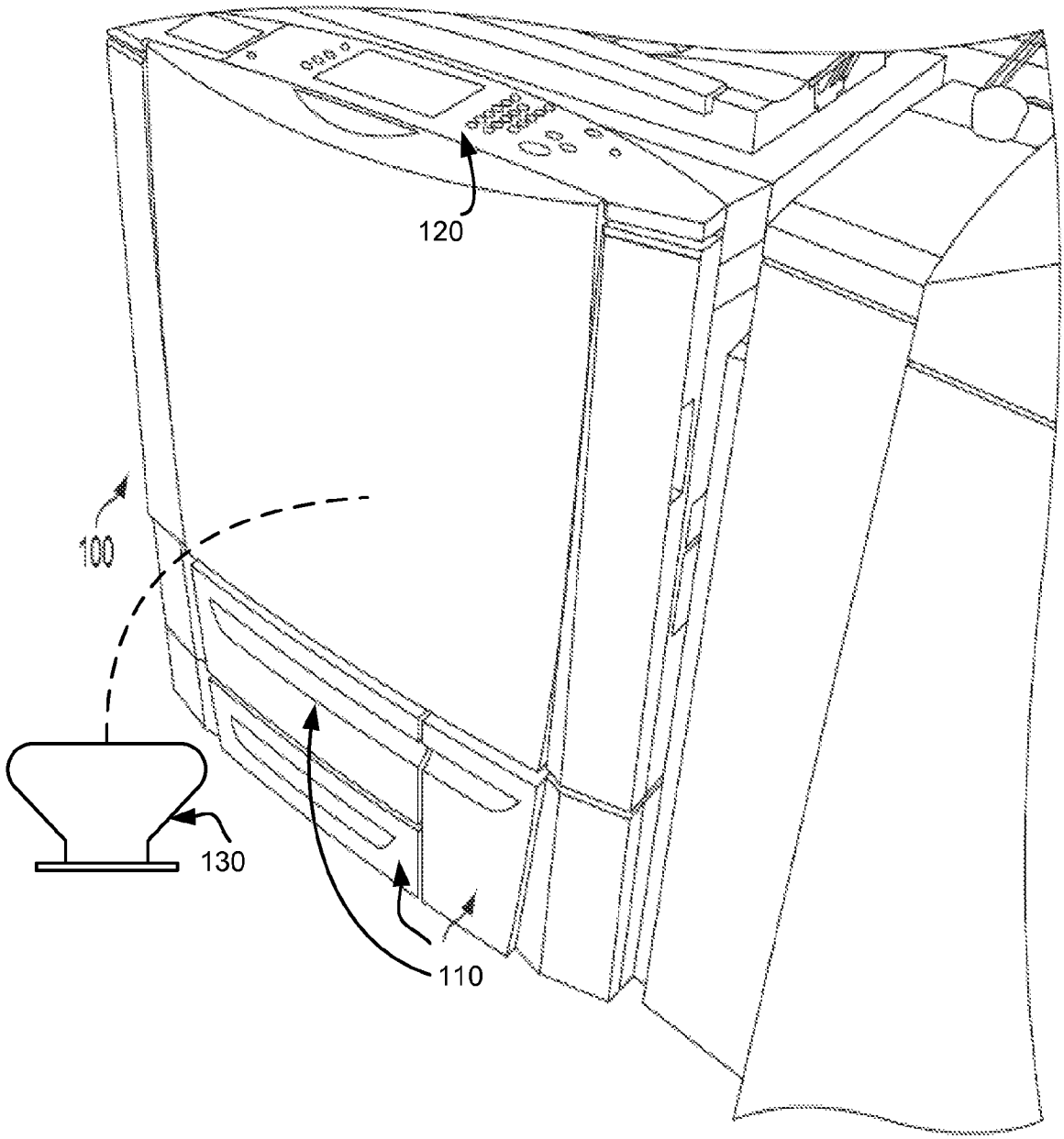
FIG. 1 is an exemplary diagram of an image production device in accordance with one possible embodiment of the disclosure.

Aspects of the embodiments disclosed herein relate to indicating a part number for a consumable to be used in an image production device, as well as corresponding apparatus and method of manufacturing.

The disclosed embodiments may include a method for indicating a part number for a consumable to be used in an image production device. The method may include generating a pre-printed label that includes one or more potential part numbers for the consumable with an indication area proximate to the one or more potential part numbers, the indication area including reactive material, attaching the preprinted label on packaging for the consumable, determining a desired part number from the one or more potential part numbers for the consumable, and indicating the desired part number for the consumable by activating the reactive material proximate to the desired part number.

The disclosed embodiments may further include an apparatus for indicating a part number for a consumable to be used in an image production device that may include a pre-printed label that includes all potential part numbers for the consumable, with an indication area proximate to the potential part numbers, the indication area including reactive material, and wherein when the preprinted label is attached to packaging for the consumable and a desired (or correct) part number for the consumable is determined, the reactive material in the indication area proximate to the desired part number is activated, thereby indicating the desired part number for the consumable.

The disclosed embodiments may include a method of manufacturing a pre-printed label useful for indicating a part number for a consumable to be used in an image production device, comprising, providing a label, including on the label all potential part numbers for the consumable, and placing an indication area proximate to each potential part number, the indication area including reactive material configured to modify a characteristic, such as appearance, in response to being activated, thereby indicating a specific part number.

Image production devices, such as, but not included to, multi-function printers (MFPs) and standalone printers may include a number of consumables (or customer replaceable units, such as, but not limited to, a toner cartridge). Through the box programming of tag memory devices that may be associated with a consumable to be used in an image production device may allow the tag memory device to be reprogrammed at a distribution center just before shipment to a customer. By utilizing through the box programming at a distribution center, additional flexibility can be achieved at manufacturing and distribution sites. There is also the opportunity to reduce total inventories held at distribution centers. Through the box programming entails only changes to a manufacturing process of consumables and a modification of processes used at distribution centers.

The changes at manufacturing sites to support through the box programming are straightforward. Instead of manufacturing both a "metered" and "sold" configurations of consumables (for example toner cartridges, which may require different tag memory programming, different toner bottle labels, and different boxes for each configuration), only one configuration will be manufactured. This single configuration of consumables may be generic in its tag programming, toner bottle labels, and box graphics. The single configuration will utilize a part number that is not customer orderable and the tag programming will be such that the toner will not be allowed to function in, for example, but not limited to, either "sold" or "metered" image production devices, or to consumables sold or supplied in a particular geographic market. This reduces the number of configurations manufactured and simplifies manufacturing processes and scheduling.

The changes at distribution sites to support through the box programming require a different method for picking product for shipment. Currently, as orders arrive at the distribution center, an operator will pick the proper parts from inventory stockpiles and assemble the order for shipment. This process must change to accommodate through the box programming because as each item that utilizes through the box programming methods is picked, it must have its tag memory programming updated and the proper part number indicated on the exterior of its box before it can be shipped to a customer.

Once the tag memory programming is changed at the distribution center, embodiments of the present disclosure provide a quick, effective, and easy method for marking the toner box with the now desired part number.

The ability for through the box programming of tag memory devices that may be associated with a consumable to be used in an image production device is described in detail in U.S. Pat. No. 7,196,627, entitled, CONTROL OF PACKAGED MODULES and assigned to the assignee of the present application. This patent is incorporated herein by reference.

The '627 patent describes processing a module packaged within a container and involves securely affixing a tag comprising a tag memory and a tag communication element to the container. While the module is enclosed in the container, information pertaining to the module is selectively stored in the tag memory for later readout and processing. A container for enclosing a module includes an electronic tag having a tag memory and a tag communication element. The tag communication element is adapted to receive information from a source, and the tag memory stores that information. While the module is packaged in the container, either first module information or second module information is stored in the tag memory. The module information pertains to the subsequent use of the module. The electronic tag is embedded in the container material, or securely affixed to the container. The electronic tag may span a container opening so that the tag is damaged upon opening the container, providing security against improper re-use.

When changing the tag memory device programming, it may be required to physically mark the packaging of the consumable to indicate that because of the tag memory device programming change, the part number of the consumable is now different. Embodiments of the present disclosure provide a method where consumables intended to be programmed through the box at distribution centers have a generic part number assigned to them and a label applied at manufacturing time that contains sections with reactive material, such as, but not limited to, thermally sensitive material or ink, proximate to potential part numbers and that when a consumable's tag memory device data is changed, the reactive material, such as the thermally sensitive material, located proximate, or next to or adjacent, the desired part number will be activated to visually or by other characteristic change, indicate the desired part number. Potential part numbers may be part numbers that a consumable can become simply by changing the data contained within the tag memory device. In an embodiment of the disclosure, the desired part number may be determined based on whether the image production device is one of owned by a user, owned by a manufacturer, and owned by a distribution entity In an embodiment of the disclosure, the characteristic change is an appearance change of the indication area upon thermal application to the temperature sensitive ink or material to indicate the desired part number. The appearance change may be a change of color upon thermal application. This now marked thermally sensitive area will visually indicate to a customer the desired part number for the toner bottle contained within the packaging. In an embodiment of the disclosure, the reactive material proximate to the desired part number may be activated using one of a hand held programming fixture and a fixed-place programming fixture that automatically activates the reactive material in the indication area proximate to the desired part number.

The packaging may comprise packaging material and the tag memory may be capable of being activated through the packaging material to enable the desired part number identification, the packaging material being at least one of a box, paper, and synthetic material. By integrating the tag programming fixture with the label marking capability, a single step process can update all aspects of a through the box programmable item before shipment to a customer.

An advantage to using reactive material marking, such as but not limited to, thermal marking over physical marking (like a pen or stamp) is that parts or toner bottle boxes located on a skid and wrapped in plastic can still be marked easily by heating the thermally sensitive areas through the plastic wrap. With physical marking devices, the plastic wrap would need to be removed from a skid of parts or toner before they could be marked. Thus, embodiments of the present disclosure would allow for skids of parts to be programmed and marked without being de-palletized.

FIG. 1 is an exemplary diagram of an image production device 100 for which a consumable, 130, such as a toner cartridge may be used in accordance with one possible embodiment of the disclosure. The image production device 100 may be any device that may be capable of making image production documents (e.g., printed documents, copies, etc.) including a copier, a printer, a facsimile device, and a multifunction device (MFD), for example.

The image production device 100 may include one or more media tray doors 110 and a local user interface 120. The one or more media tray doors 110 may provide access to one or more media trays that contain media and may provide access to consumable 130. Consumable 130 may be any item including cartridges, components, etc. that may be periodically replaced by the user or maintenance personal when required, consumed, or they have reached their end-of-life (EOL). Examples of consumables 130 may be toner cartridges, ink cartridges, imaging drums, etc. Consumables 130 are typically posted to customer sites as required, usually this supply may be controlled by the consumable management unit monitoring the life of the consumable 130 and requesting a reorder as necessary.

The user interface 120 may contain one or more display screens (which may be a touchscreen or simply a display), and a number of buttons, knobs, switches, etc. to be used by a user to control image production device 100 operations. The one or more display screen may also display warnings, alerts, instructions, and information to a user. While the user interface 120 may accept user inputs, another source of image data and instructions may include inputs from any number of computers to which the printer is connected via a network.

Figure 2:
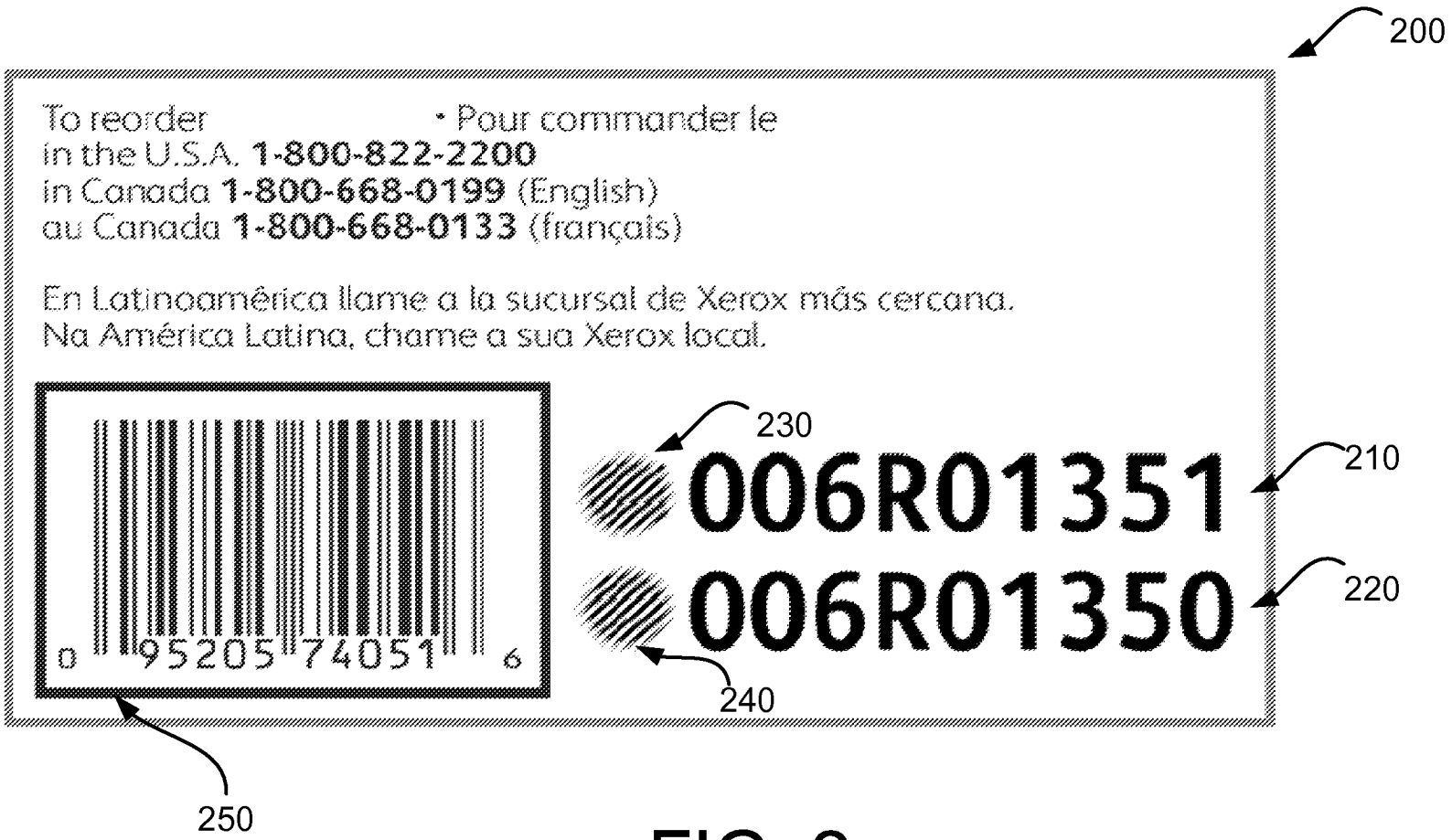
FIG. 2 is an exemplary pre-printed label in accordance with one possible embodiment of the disclosure.

FIG. 2 illustrates an apparatus, such as a label 200, for indicating a part number for a consumable 130 to be used in an image production device 100. Label 200 may include one or more (or all, if desired) potential part numbers 210, 220 for the consumable 130 with indication areas 230, 240 proximate to the potential part numbers 210, 220, the indication area including reactive material. The reactive material may be temperature sensitive ink or material, ultra-violet (UV) sensitive, infra-red (IR) sensitive, etc., for example. As mentioned above, label 200 may be attached to packaging for the consumable 130 and when a desired part number for the consumable 130 to be used in an image production device 100 is determined, the reactive material in the indication areas 230, 240 proximate to the desired part numbers 210, 220 is activated, thereby indicating the desired (or correct) part number for the consumable 130.

The desired part number may be a part number that matched to a tag memory device associated with the consumable 130, for example. The desired part number may be determined based on whether the image production device 100 is owned by a user, owned by a manufacturer, owned by a distribution entity, or sold or supplied in a particular geographic market, for example. In this manner, the potential part numbers 210, 220 may each indicate the entity owning the image production device and as such, how the consumable 130 is accounted and what entity is responsible for the cost of the consumable, for example. The packaging may comprise packaging material and the tag memory is capable of being activated through the packaging material to enable the desired part number identification. The packaging material may be at least one of a box, paper, and synthetic material, for example.

The indication areas 230, 240, may, in one example, be yellow and black striped areas that may be thermally sensitive. When not activated, the indication areas 230, 240 may be white, for example. When activated using a thermal heat source, the indication areas 230, 240 may be yellow and black striped to show which part number is correct/desired. It is understood that any method of indication and indication change, such as a characteristic change, which may include color, shape, pattern, sound, sight, texture, size, reflectivity etc., is anticipated by the present disclosure. The reactive material in the indication areas 230, 240 will stay the same once it is changed. In addition, the activation of the indication areas 230, 240 may be such that more than one consumable's indication area 230, 240 may be changed at a time (a whole pallet of consumables changing their part numbers/indication areas, for example).

Although not required in the present invention, a bar code 250 may be a stock-keeping unit (SKU) number used to identify a billable item in a company's inventory and may be included on label 200.

Figure 3:
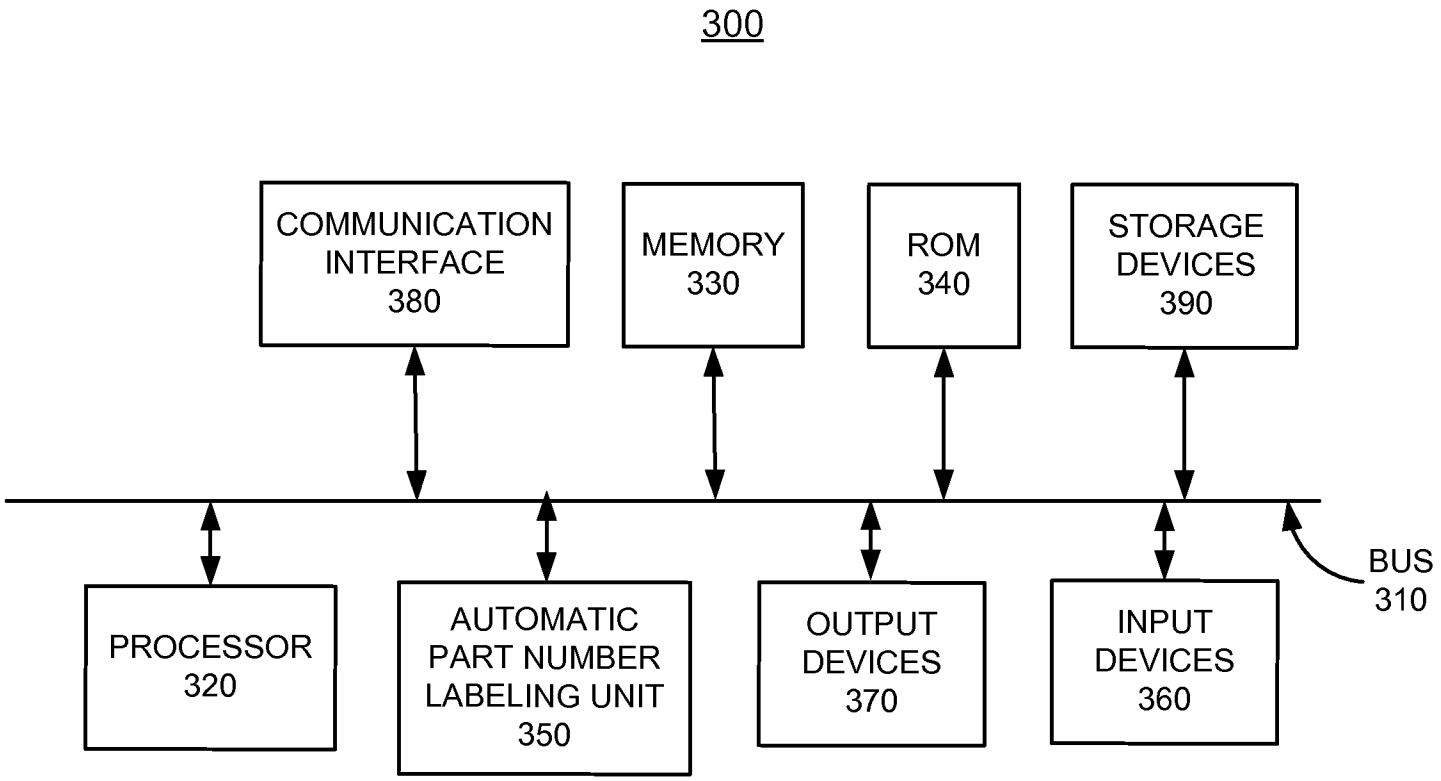
FIG. 3 is an exemplary block diagram of the consumable package processing unit in accordance with one possible embodiment of the disclosure.

FIG. 3 is an exemplary block diagram of the consumable package processing unit 300 in accordance with one possible embodiment of the disclosure. The consumable package processing unit 300 may be a server, computer, handheld computer, mobile device, or processing device, for example. The consumable package processing unit 300 may include a bus 310, a processor 320, a memory 330, a read only memory (ROM) 340, an automatic part number labeling unit 350, input devices 360, output devices 370, a communication interface 380, and storage device 390. Bus 310 may permit communication among the components of the consumable package processing unit 300.

Processor 320 may include at least one conventional processor or microprocessor that interprets and executes instructions. The memory 330 may be a random access memory (RAM) or another type of dynamic storage device that stores information and instructions for execution by processor 320. The memory 330 may also include a read-only memory (ROM) 340 which may include a conventional ROM device or another type of static storage device that stores static information and instructions for processor 320.

Input devices 360 may include one or more conventional mechanisms that permit a user to input information to the consumable package processing unit 300, such as a keyboard, a mouse, a pen, a voice recognition device, etc. Output devices 370 may include one or more conventional mechanisms that output information to the user, including a display, a printer, one or more speakers, or a medium, such as a memory, or a magnetic or optical disk and a corresponding disk drive.

Communication interface 380 may include any mechanism that facilitates communication via a network. For example, the communication interface 380 may include a modem. Alternatively, communication interface 380 may include other mechanisms for assisting in communications with other devices and/or systems.

ROM 340 may include a conventional ROM device or another type of static storage device that stores static information and instructions for processor 320. The storage devices 390 may augment the ROM 340 and may include any type of storage media, such as, for example, magnetic or optical recording media and its corresponding drive.

The consumable package processing unit 300 may perform such functions in response to processor 320 by executing sequences of instructions contained in a computer-readable medium, such as, for example, the memory 330. Such instructions may be read into the memory 330 from another computer-readable medium, such as a storage device or from a separate device via communication interface 380.

The consumable package processing unit 300 illustrated in FIG. 3 and the related discussion were intended to provide a brief, general description of a suitable communication and processing environment in which the disclosure may be implemented. Although not required, the disclosure will be described, at least in part, in the general context of computer-executable instructions, such as program modules, being executed by the consumable package processing unit 300, which may be a server, a computer, a handheld computer, and a processing device, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the automatic part number labeling unit 450 and the automatic part number labeling process will be discussed below in relation to the flowcharts in FIGS. 4 and 5.

Figure 4:
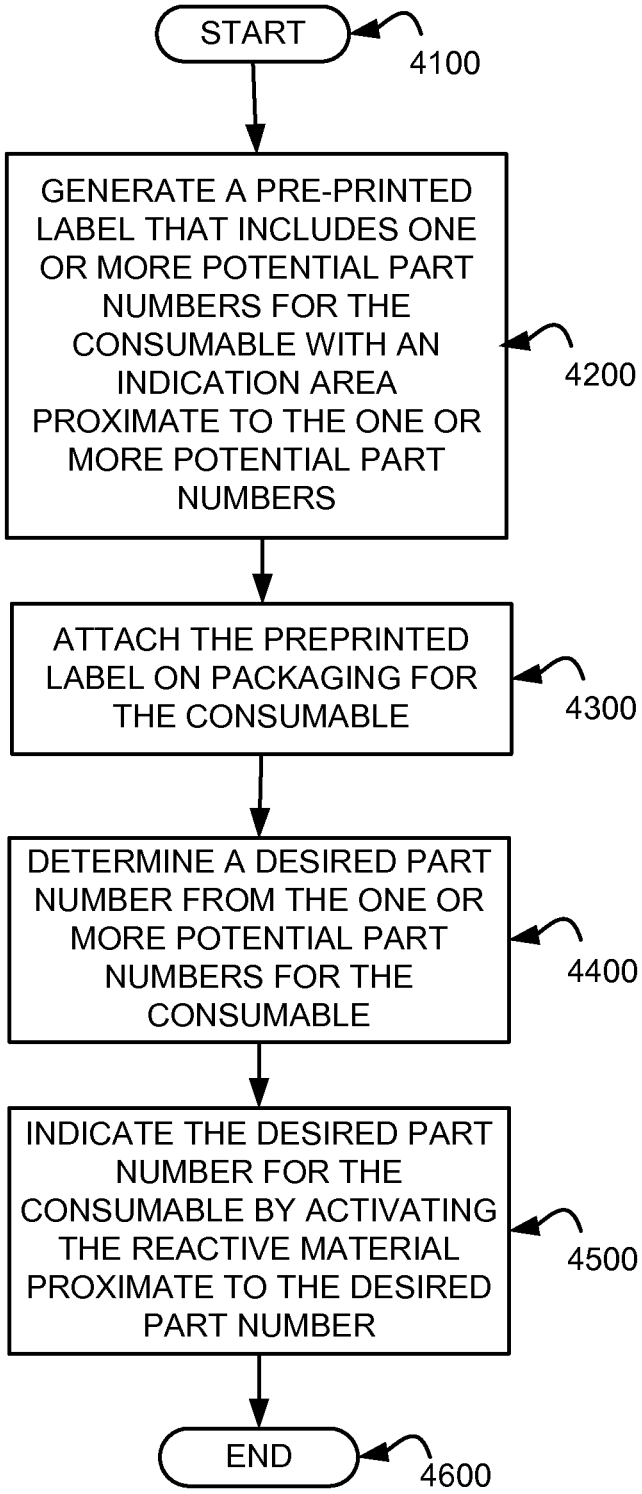
FIG. 4 is a flowchart of an exemplary process for indicating a part number for a consumable to be used in an image production device in accordance with one possible embodiment of the disclosure.

FIG. 4 is a flowchart of an exemplary part numbers labeling process for a consumable 130 to be used in an image production device 100. The process may begin at step 4100 and may continue to step 4200 wherein the automatic part number labeling unit 450 may generate a pre-printed label 200 that includes one or more potential part numbers 210, 220 for the consumable 130 with an indication area 230, 240 proximate to the one or more potential part numbers 210, 220. The indication area 230, 240 may include reactive material, for example.

At step 4300, the automatic part number labeling unit 450 may attach the preprinted label 220 on packaging for the consumable 130. At step 4400, the automatic part number labeling unit 450 may determine a desired part number from the one or more potential part numbers 210, 220 for the consumable. At step 4500, the automatic part number labeling unit 450 may indicate the desired part number for the consumable by activating the reactive material proximate to the desired part number. The indication area 230, 240 may characteristically change from the activation of the reactive material to indicate the desired part number, for example. Such change may be a change in color, pattern, shape, sound, sight, texture, size, reflectivity, etc., for example. The reactive material proximate to the desired part number may be activated using a hand held programming fixture, a fixed-place programming fixture, or any other known fixture that may automatically activate the reactive material in the indication area proximate to the desired part number. The process may then go to step 4600 and end.

Figure 5:
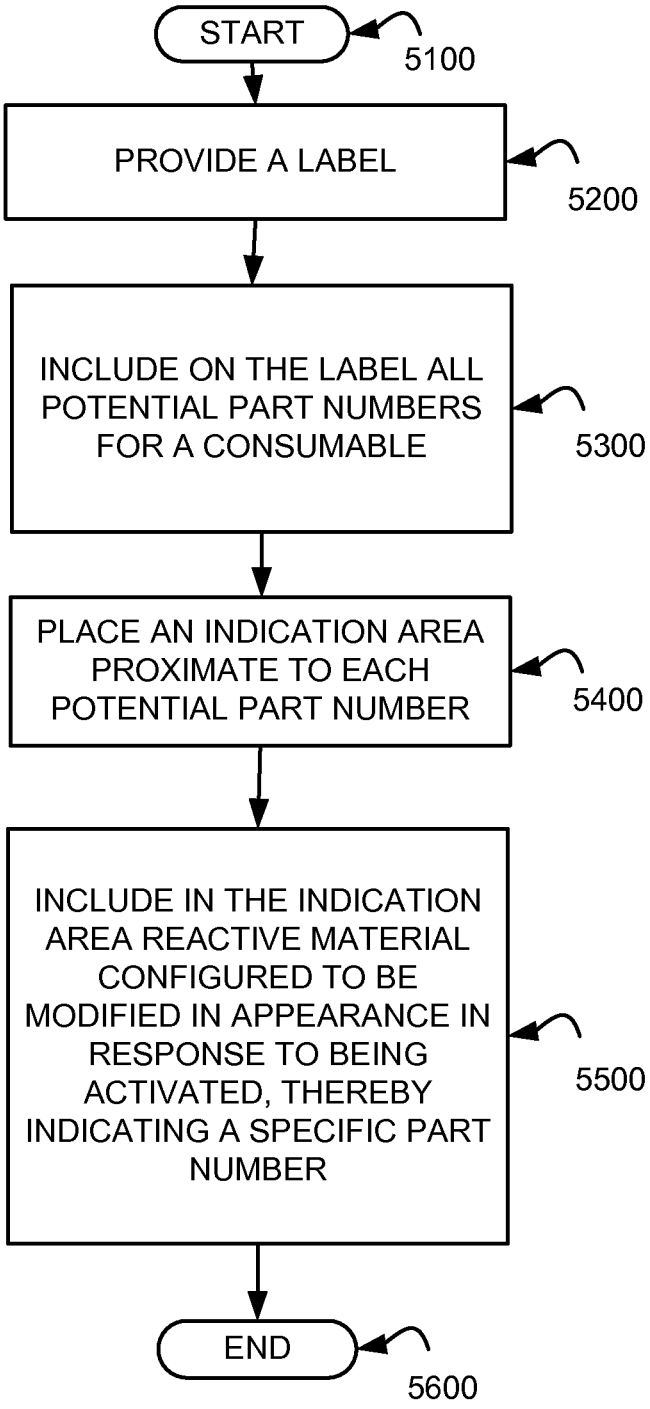
FIG. 5 is a flowchart of an exemplary process for manufacturing a pre-printed label useful for indicating a part number for a consumable to be used in an image production device in accordance with one possible embodiment of the disclosure.

FIG. 5 is a flowchart of an exemplary process for manufacturing a pre-printed label 200 useful for indicating part numbers 210, 220 for a consumable 130 to be used in an image production device 100. The process may begin at step 5100 and may continue to step 5200 where the automatic part number labeling unit 450 may provide a label 200. At step 5300, the automatic part number labeling unit 450 may include one or more potential part numbers 210, 220 for the consumable 130 on the label 200. At step 5400, the automatic part number labeling unit 450 may place indication areas 230, 240 proximate to potential part numbers 210, 220. At step 5500, the automatic part number labeling unit 450 may include a reactive material into indication areas 230, 240. The reactive material may be configured to modify color, pattern, shape, sound, sight, texture, size, reflectivity, etc. as desired, in response to being activated, thereby indicating a specific part number, for example. The process may then go to step 5600 and end.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for indicating a part number for a consumable to be used in an image production device, comprising:

generating a pre-printed label that includes one or more potential part numbers for the consumable with an indication area proximate to the one or more potential part numbers, the indication area including reactive material;

attaching the preprinted label on packaging for the consumable;

determining a desired part number from the one or more potential part numbers for the consumable; and indicating the desired part number for the consumable by activating the reactive material proximate to the desired part number.

2. The method of claim 1, wherein the reactive material is temperature sensitive ink or material and activating the reactive material proximate to the desired part number is accomplished thermally.

3. The method of claim 2, wherein an appearance of the indication area changes upon thermal application to the temperature sensitive ink or material to indicate the desired part number.

4. The method of claim 3, wherein the appearance change is a change in at least one of color, pattern, and texture upon thermal application.

5. The method of claim 1, wherein the desired part number is a part number that is matched to a tag memory device associated with the consumable.

6. The method of claim 1, wherein the reactive material proximate to the desired part number is activated using one of a hand held programming fixture and a fixed-place programming fixture that automatically activates the reactive material in the indication area proximate to the desired part number.

7. The method of claim 1, wherein the packaging comprises packaging material and the tag memory is capable of being activated through the packaging material to enable the desired part number identification, the packaging material being at least one of a box, paper, and synthetic material.

8. The method of claim 1, wherein the desired part number is determined based on whether the image production device is one of owned by a user, owned by a manufacturer, owned by a distribution entity, or sold or supplied in a particular geographic market.

9. An apparatus for indicating a part number for a consumable to be used in an image production device, comprising:

an automatic part number labeling unit that generates the pre-printed label that includes one or more potential part numbers for the consumable with an indication area proximate to the one or more potential part numbers, the indication area including reactive material, attaches the preprinted label on packaging for the consumable, determines a desired part number from the one or more potential part numbers for the consumable, and indicates the desired part number for the consumable by activating the reactive material proximate to the desired part number.

10. The apparatus of claim 9, wherein the reactive material is temperature sensitive ink or material and activating the reactive material in the indication area proximate to the desired part number is accomplished thermally.

11. The apparatus of claim 10, wherein an appearance of the indication area changes upon thermal application to the temperature sensitive ink or material to indicate the desired part number.

12. The apparatus of claim 10, wherein the appearance change is a change in at least one of color, pattern, and texture upon thermal application.

13. The apparatus of claim 9, wherein the desired part number is a part number that is matched to a tag memory device associated with the consumable.

14. The apparatus of claim 9, wherein the reactive material proximate to the desired part number is activated using one of a hand held programming fixture and a fixed-place programming fixture that automatically activates the reactive material in the indication area proximate to the desired part number.

15. The apparatus of claim 9, wherein the packaging comprises packaging material and the tag memory is capable of being activated through the packaging material to enable the desired part number identification, the packaging material being at least one of a box, paper, and synthetic material.

16. The apparatus of claim 9, wherein the automatic part number labeling unit determines the desired part number based on whether the image production device is one of owned by a user, owned by a manufacturer, owned by a distribution entity, or sold or supplied in a particular geographic market.

17. A method of manufacturing a pre-printed label useful for indicating a part number for a consumable to be used in an image production device, comprising:

providing a label;

including on the label all potential part numbers for the consumable; and placing an indication area proximate to each potential part number, the indication area including reactive material configured to modify appearance in response to being activated, thereby indicating a specific part number.

18. The method of claim 17, wherein the reactive material is thermally sensitive ink or material and activating the reactive material in the indication area proximate to the desired part number is accomplished thermally.

19. The method of claim 18, wherein an appearance of the indication area changes upon thermal application to the temperature sensitive ink or material to indicate the desired part number.

20. The method of claim 18, wherein the appearance change is a change in at least one of color, pattern, and texture upon thermal application.

21. The method of claim 17, wherein the desired part number is a part number that is matched to a tag memory device associated with the consumable.

22. The method of claim 17, wherein the reactive material proximate to the desired part number is activated using one of a hand held programming fixture and a fixed-place programming fixture that automatically activates the reactive material in the indication area proximate to the desired part number.

23. The method of claim 17, wherein the packaging comprises packaging material and the tag memory is capable of being activated through the packaging material to enable the desired part number identification, the packaging material being at least one of a box, paper, and synthetic material.

24. The method of claim 17, wherein the desired part number is determined based on whether the image production device is one of owned by a user, owned by a manufacturer, owned by a distribution entity, or sold or supplied in a particular geographic market.

25. A pre-printed label for indicating a part number for a consumable to be used in an image production device, comprising:

one or more potential part numbers for the consumable;

an indication area proximate to the potential part numbers, the indication area including reactive material, wherein when the preprinted label is attached to packaging for the consumable and a desired part number for the consumable is determined from the one or more potential part numbers, the reactive material in the indication area proximate to the desired part number is activated, thereby indicating the desired part number for the consumable.

* * * * *